United States Patent [19]

Coker et al.

[11] 4,209,368

[45] Jun. 24, 1980

[54] PRODUCTION OF HALOGENS BY ELECTROLYSIS OF ALKALI METAL HALIDES IN A CELL HAVING CATALYTIC ELECTRODES BONDED TO THE SURFACE OF A POROUS MEMBRANE/SEPARATOR

[75] Inventors: Thomas G. Coker, Waltham; Anthony B. La Conti, Lynnfield, both of Mass.

[73] Assignee: General Electric Company, Wilmington, Mass.

[21] Appl. No.: 931,413

[22] Filed: Aug. 7, 1978

[51] Int. Cl.[2] ..... C25B 1/34; C25B 9/04; C25B 13/08; C25B 11/08

[52] U.S. Cl. ..... 204/98; 204/128; 204/283; 204/296

[58] Field of Search ..... 204/98, 128, 283, 296

[56] References Cited

U.S. PATENT DOCUMENTS

| | | | |
|---|---|---|---|
| 3,222,265 | 12/1965 | Beer | 204/295 |
| 3,853,720 | 12/1974 | Korach et al. | 204/295 |
| 4,032,427 | 6/1977 | Kadija | 204/295 |
| 4,120,772 | 10/1978 | Kadija | 204/283 |

FOREIGN PATENT DOCUMENTS

| | | | |
|---|---|---|---|
| 811128 | 4/1969 | Canada | 204/283 |

*Primary Examiner*—R. L. Andrews
*Attorney, Agent, or Firm*—I David Blumenfeld

[57] ABSTRACT

A halogen, such as chlorine, is generated in an electrolysis cell in which at least one of the cell electrodes is bonded to the surface of a solid but porous membrane which separates the cell into anode and cathode chambers. A pressurized aqueous metal halide such as brine is electrolyzed at the anode to produce chlorine. Brine anolyte and sodium ions are hydraulically transported across the porous membrane to produce caustic (NaOH) at the cathode. By bonding at least one gas permeable, porous electrode to the hydraulically permeable membrane, the cell voltage for electrolysis of brine is considerably lower than that required for asbestos diaphragm cells, while achieving high cathodic current efficiencies by minimizing back migration of caustic to the anode.

6 Claims, 3 Drawing Figures

PRODUCTION OF HALOGENS BY ELECTROLYSIS OF ALKALI METAL HALIDES IN A CELL HAVING CATALYTIC ELECTRODES BONDED TO THE SURFACE OF A POROUS MEMBRANE/SEPARATOR

This invention relates to a process and apparatus for producing halogens and alkali metal hydroxides by electrolysis of aqueous alkali metal halides. More specifically, the invention relates to a process and apparatus for producing chlorine and sodium hydroxide by electrolysis of brine in a cell utilizing a porous, hydraulically permeable membrane having at least one catalytic electrode bonded to the surface of the porous membrane.

It is well known to generate halogens such as chlorine by electrolysis of aqueous alkali metal chlorides such as sodium chloride in a cell in which the electrodes are separated by a hydraulically permeable diaphragm or separator which permits passage of the sodium chloride anolyte from the anode to the cathode. Such hydraulically permeable diaphragms are typically fabricated of asbestos fibers and include passages through which the anolyte and sodium ions are physically transported to the cathode. Electrolysis of brine in such a cell produces chlorine at the anode and sodium hydroxide at the cathode. Electrolysis normally is conducted with graphite or metallic anodes which are physically separated from the asbestos diaphragm while the cathodes are usually open mesh screens of iron, steel, stainless steel, nickel, or similar materials, which are also physically separated from the diaphragm.

Asbestos diaphragm cells, or the like, are characterized by high cathode current efficiencies, fairly low concentrations of sodium hydroxide and relatively high cell voltages at fairly low current densities; i.e., 3.3 volts at a maximum of 150 amperes per square foot. Current density in asbestos diaphragm cells is limited because the asbestos fiber diaphragm is susceptible to damage or destruction due to rapid gas evolution at high current density.

Applicants have found that by bonding catalytic electrodes at least to one side of a porous but non-fibrous membrane an improved apparatus and process for electrolyzing aqueous alkali metal halides is possible at much higher current densities and at cell operating voltages considerably lower than those possible in asbestos diaphragm cells.

It is therefore a primary objective of this invention to produce halogens efficiently by electrolysis of alkali metal halide solutions in a cell utilizing a unitary membrane-electrode structure in which the membrane is also hydraulically permeable.

It is a further objective of this invention to provide a method and apparatus for producing chlorine by the electrolysis of aqueous sodium chloride wherein the cell voltage is substantially reduced by bonding at least one catalytic electrode to a porous, hydraulically permeable membrane.

Still another objective of the invention is to provide a method and apparatus for producing chlorine by the electrolysis of aqueous sodium chloride with substantially lower cell voltages and high current efficiency by using both a porous membrane and electrodes bonded to the membrane.

Other objectives and advantages of the invention will become apparent as the description thereof proceeds.

In accordance with the invention, halogens, i.e., chlorine, bromine, etc., are generated by electrolyzing an aqueous alkali metal halide, such as NaCl, etc., in a cell which includes a discontinuous, hydraulically permeable membrane having at least one porous, gas permeable catalytic electrode bonded to the surface of the membrane. The discontinuities in the membrane take the form of randomly interconnected micro pores which extend through the membrane. Pressurized anolyte is brought into the cell anode chamber and the pressurized anolyte passes through the porous anode to the membrane. The anolyte and sodium ions are hydraulically transported across the membrane to form NaOH at the cathode. The pressurized anolyte sweeps NaOH away from the cathode, thereby minimizing back migration of sodium hydroxide to the anode.

The thin, porous, gas permeable catalytic electrode is bonded at least to one surface of the membrane at a plurality of points. By bonding the electrodes to the membrane, "electrolyte IR" drop between the electrode and the membrane is minimized, as is gas mass transport loss due to the formation of gaseous layers between the electrodes and the membrane. As a result, the cell voltage required for electrolysis of the halide solution is reduced substantially. In addition, by using a porous but solid membrane, operation at much higher current densities (300 ASF or more) is possible; operation at current densities at which gas is generated so rapidly that asbestos diaphragms are subject to serious damage or destruction. In addition, the need for asbestos (with its many undesirable environmental characteristics and its potential health hazards) is avoided.

The electrodes which are bonded to the porous membranes include catalytic material comprising at least one reduced, platinum group metal oxide which is thermally stabilized by heating the reduced oxides in the presence of oxygen. Examples of useful platinum group metals are platinum, palladium, iridium, rhodium, ruthenium, and osmium. For chlorine production, the preferred reduced metal oxides are reduced oxides of ruthenium or iridium. Mixtures or alloys of reduced platinum group metal oxides have been found to be the most stable. Thermally stabilized, reduced oxides of ruthenium containing up to 25 percent by weight of thermally stabilized, reduced oxides of iridium have been found very stable and corrosion resistant. Graphite or other conductive extenders, such as ruthenized titanium, etc., may be added in amounts of up to 90 percent by weight. The extenders should have good conductivity with a low halogen overvoltage and should be substantially less expensive than platinum group metals. One or more reduced oxides of a valve metal such as titanium, tantalum, niobium, hafnium, vanadium or tungsten may be added to stabilize the electrode against oxygen, chlorine, and the generally harsh electrolysis conditions. Reference is hereby made to application Ser. No. 922,316, filed July 6, 1978 (52-EE-0-299) assigned to the General Electric Company, assignee of the present invention, for additional description of the catalytic electrode constructions most useful in electrolysis cells for the electrolysis of aqueous alkali metal halides.

The novel features which are believed to be characteristic of this invention are set forth with particularity in the appended claims. The invention itself, however, both as to its organization and method of operation, together with further objectives and advantages, may best be understood by reference to the following description taken in connection with the accompanying drawings in which:

Figure 3:
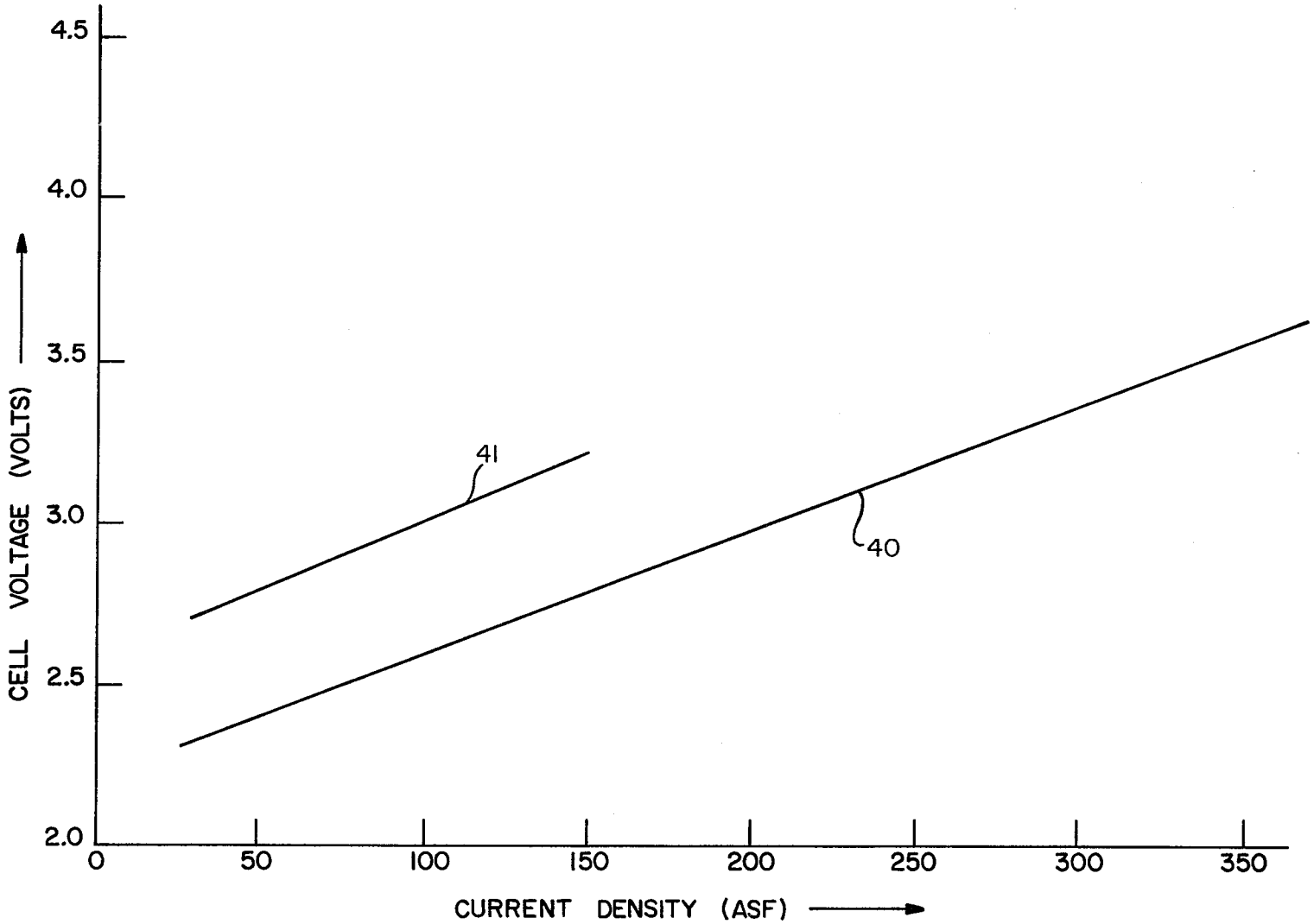

FIG. 3 graphically compares the operational characteristics of cells using a porous membrane and an asbestos diaphragm cell.

Figure 1:
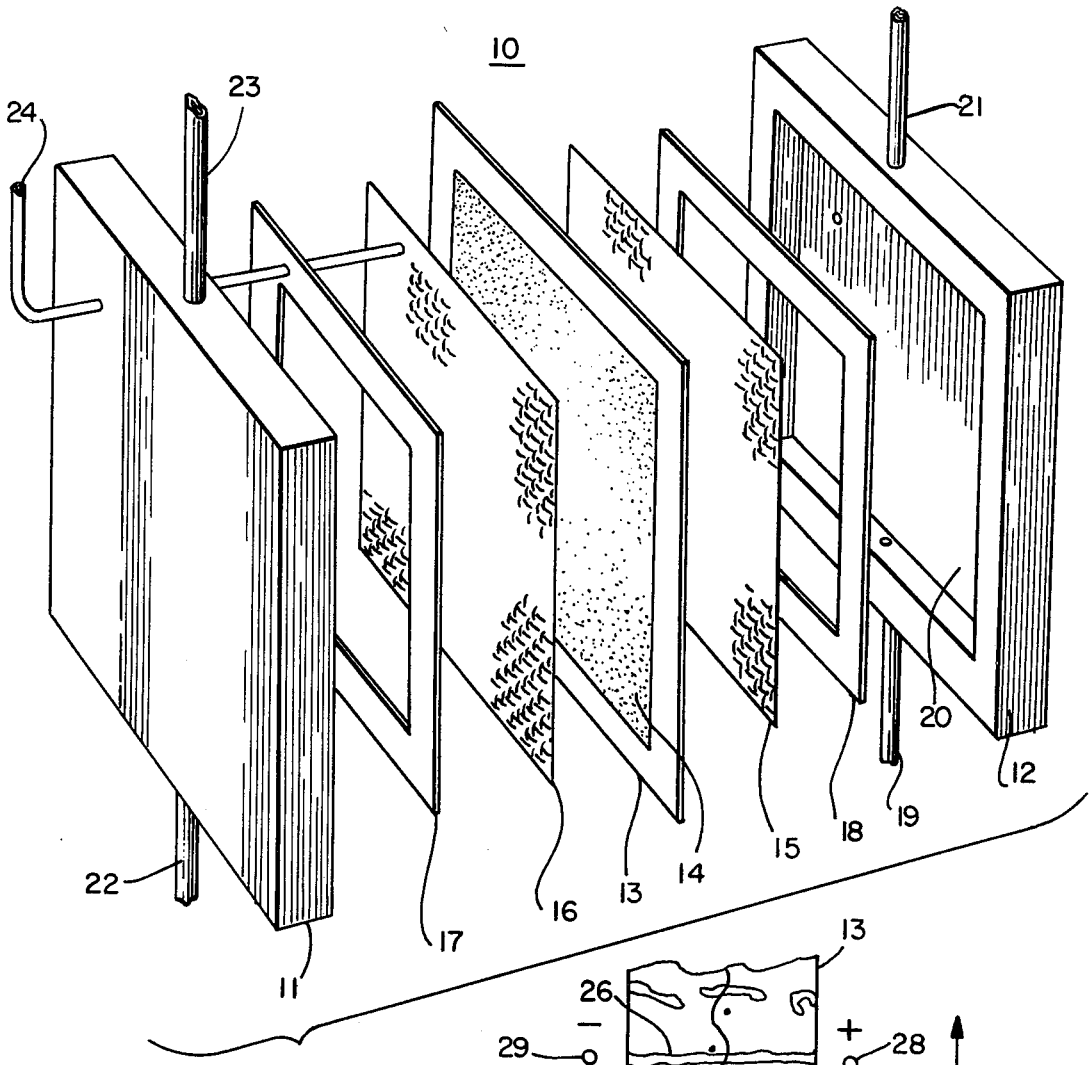
FIG. 1 is an exploded diagrammatic illustration of an electrolysis cell constructed in accordance with the invention.

Referring now to FIG. 1, the electrolysis cell is shown generally at 10 and consists of a cathode compartment 11, an anode compartment 12, separated by a porous, membrane 13, which is preferably a hydrated, microporous, permselective cationic polymer membrane. By microporous is meant a membrane having a plurality of pores extending randomly from one side of the membrane to the other to establish labyrinthene hydraulic fluid transporting passage across the membrane. The micropore cross sectional area is in the range of 5 to 20/square micron. The average length is 30 microns with the membrane having a void volume ranging from 30 to 60 percent with 40 to 50 percent being preferred.

A catalytic anode electrode is bonded to one side of membrane 13 at a plurality of points, with the electrode preferably comprising fluorocarbon particles, such as those sold by Dupont under its trade designation Teflon, bonded in an agglomerated mass to particles of thermally stabilized reduced oxides of one or more platinum group metals with or without graphite or valve metals. Cathode 14 is shown as bonded to the other side of the membrane, although it is not necessary for the cathode to be bonded to the membrane, since many of the improvements associated with the instant invention will be obtained with only one of the electrodes bonded to the membrane. The Teflon-bonded cathode may be similar to the anode and contains suitable catalysts such as finely divided metals of platinum, palladium, gold, silver, spinels, manganese, cobalt, nickel, as well as thermally stabilized reduced, platinum group metals such as those discussed above with or without graphite, and suitable combinations thereof. In the event the cathode is not bonded to the membrane, it may take the form titanium, nickel, etc., screens either alone or containing one or more of the above-mentioned catalysts as a coating.

Current collectors in the form of metallic screens 15 and 16 are pressed against the electrodes bonded to the surface of the membrane. The entire membrane/electrode assembly is firmly supported between the housing elements by means of gaskets 17 and 18 which are made of any material resistant to the cell environment. The aqueous brine anolyte solution is introduced into the anode chamber under pressure through a conduit 19 which communicates with the chamber. Spent anolyte and chlorine gas are removed through an outlet conduit 20 which also communicates with the anode chamber. Catholyte either in the form of water dilute aqueous sodium hydroxide (more dilute than that formed electrochemically at the anode) is introduced into the cathode chamber through an inlet conduit 22. A portion of the water is electrolyzed to produce hydroxyl ($OH^-$) anions which combine with the sodium cations transported across the membrane, either by ion exchange or in the anolyte transported through the pores, to form caustic. The catholyte also sweeps across the bonded cathode to dilute the caustic formed at the cathode membrane interface which has penetrated through the porous electrode to its surface. Catholyte sweep of the cathode, in conjunction with the anolyte pumped across the membrane, moves the caustic away from the membrane and the cathode thereby minimizing back migration of caustic to the anode. Excess catholyte, caustic, hydrogen discharged at the cathode, as well as any anolyte pumped across the membrane are removed from the cathode chamber through an outlet conduit 23. A suitable power cable 24 is brought into the cathode and anode chambers to connect the current conducting screens 15 and 16 to a source of electrical power to apply the cell electrolysis voltage across the electrodes.

Figure 2:
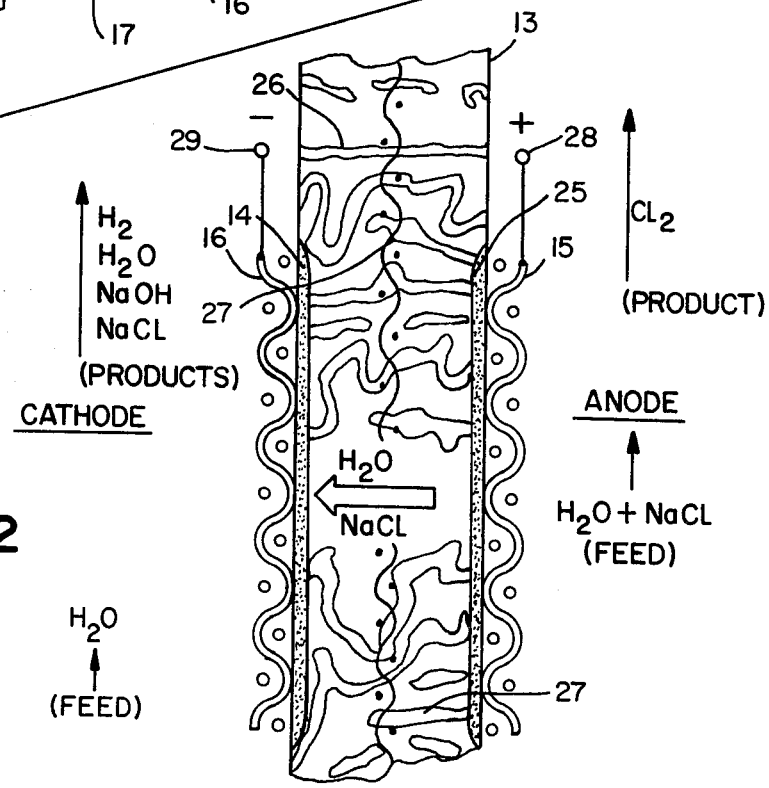
FIG. 2 is a schematic illustration of the cell with bonded electrodes and porous, hydraulically permeable membrane.

FIG. 2 illustrates diagrammatically the reactions taking place during brine electrodes in a cell incorporating a microporous membrane with catalytic electrodes bonded to the surface of the membrane. Membrane 13 is a hydraulically permeable, organic polymer cation exchanging, porous laminate such as DuPont NAFION 701 although porous inorganic ion exchangers such as zirconium phosphates, titanates, etc., as well as non-ion exchanging membranes, i.e., porous fluorocarbons such as porous Teflon and other materials such as polyvinyl chlorides, may be used with equal facility. Sodium cations are transported to the cathode both by ion exchange through the membrane and in the aqueous alkali metal halide which flows through the randomly distributed, labyrinthene micropores 14 extending through the membrane. The bulk of ions transported to the cathode are transported through the anolyte hydraulically pumped across the membrane. Membrane 13 also includes randomly disposed pores 24 which extend only partially through the membrane.

The pore distribution is a result of the particular construction of micropores membrane such as Nafion 701 which, as will be pointed out in detail later, are initially fabricated of a mixture of rayon, paper, and other fibers, embedded with a suitable resin in a cloth backing. The rayon, paper and other sacrificial fibers, are thereafter leached out to provide a random distribution of pores such as pores 14 which extend entirely through the membrane and pores 24 which extend only partially through the membrane. A pressurized aqueous solution of an alkali metal halide such as sodium chloride is brought into the anode compartment which is separated from the cathode compartment by membrane 13. A Teflon-bonded, catalytic anode electrode 25, which may include thermally stabilized, reduced oxides of platinum groups such as ruthenium, iridium, ruthenium-iridium, etc., is bonded to and embedded in one surface of membrane 13. Similarly, a Teflon-bonded cathode 14 is shown bonded to the other surface of the membrane. Current collectors 15 and 16 contact the catalytic electrodes and are connected through terminals 26 and 27 to a suitable voltage source to impress the electrolysis potential across the cell. Anode 25, as will be described in detail later, is gas permeable and sufficiently porous to allow passage of the sodium chloride solution to the surface of the membrane. Sodium chloride is electrolyzed at the anode to produce chlorine gas and sodium ions. Some of the sodium ions are transported through the cation exchanging membrane to the cathode. Part of the anolyte, along with sodium ions, is transported through pores 14 to the cathode. The catholyte stream of water or dilute NaOH is swept across the surface of cathode 14. Part of the water is electrolyzed at the cathode in an alkaline reaction to form hydroxyl ions and gaseous hydrogen. The hydroxyl ions combine with the sodium ions transported across the membrane by ion exchange and those transported in the anolyte solution through pores 14 to produce sodium hydroxide.

The anolyte is pressurized to produce hydraulic pumping of the anolyte across the membrane through the pores and to establish hydraulic pressure at the cathode side which forces the sodium hydroxide away from the membrane and cathode interface, thereby minimizing back migration of the caustic to the anode. This, of course, has a beneficial effect on cathode current efficiency and also minimizes parasitic reactions due to the electrolysis of caustic at the anode. The reactions in various portions of the cell utilizing a micropores membrane with at least one electrode bonded to the surface of the membrane are as follows:

| | | |
|---|---|---|
| Anode: | $2\,Cl^- \rightarrow Cl_2 \uparrow + 2e^-$ | (1) |
| Membrane Transport: | $NaCl + H_2O + 2\,Na^+$ | (2) |
| Cathode: | $2H_2O + 2e^- \rightarrow 2\,OH^- + H_2$ | 3(a) |
| | $2Na^+ + 20H^- \rightarrow 2\,NaOH$ | 3(b) |
| Overall: | $2NaCl + 2H_2O \rightarrow 2NaOH + Cl_2 \uparrow + H_2$ | (4) |

The novel process described herein is characterized by the fact that electrolysis takes place in a cell in which at least one of the catalytic electrodes is bonded directly to the membrane. Consequently, there is no IR drop to speak of in the electrolyte between the electrode and the membrane. This IR drop, usually referred to as "electrolyte IR drop" is characteristic of existing systems and processes in which electrodes are spaced from the membrane. By eliminating or substantially reducing this IR drop, cell electrolysis voltage is reduced substantially.

Furthermore, because gaseous electrolysis products are generated directly at the electrode/membrane interface, there is no gas blinding and gas mass transport IR drop. In prior art electrolyzers, gas is generated at the electrode and a gas layer is formed in the space between the diaphragm and the electrode. The electrolyte path between the electride and the diaphragm or membrane is interrupted thereby increasing the IR drop. By bonding electrodes to the membrane, a voltage saving of 0.6 V over conventional asbestos diaphragm cells is realized.

MEMBRANE

Though the membrane is porous and hydraulically permeable, it is non-fibrous and, unlike an asbestos fiber diaphragm, is not susceptible to swelling and thus not subject to increases in resistance that accompany swelling. It is also not subject to damage due to rapid gas generation when operating at high current densities. It is well known that asbestos diaphragms are susceptible to damage at high current densities because asbestos fibers are dislodged by the rapidly evolving gas thereby limiting the current density at which asbestos diaphragm cells can be operated to about 150 ASF. The membrane must be made of a material which is both stable in halogens such as chlorine and in alkali metal hydroxides such as NaOH.

The membrane may be an ion perselective membrane, such as cation exchange membrane, but it is not limited thereto as non ion selective materials may be used. The pores may be of uniform diameter passign straight through the membrane or they may be of a winding labyrinthene nature.

Labyrinthene pores with their greater path length (approximately 3 times membrane thickness) are preferred as it is believed that they are more effective in preventing back migration of caustic. Preferably the cell membrane-separator is a cationic membrane with randomly distributed, labyrinthene pores.

Non-ion selective membrane-separators, such as porous polytetrafluoroethylene sheets (i.e., Dupont Teflon), may be utilized in which event transport of the halide ion is solely through the anolyte passing through the pores. When a permselective membrane is utilized, halide ion transport occurs both through anolyte in the pores and by ion exchange in the membrane.

In the preferred embodiment, the cation exchange is a microporous laminate of a homogeneous, 7 mil film of 1100 equivalent weight of sulfonic acid resin supported by a Teflon T-12 fabric. The membrane is sold by the DuPont Company under its trade name Nafion 701. The membrane is hydraulically permeable and includes randomly distributed labyrinthene micropores which are generally rectangular in shape and which extend through the membrane. Pore dimensions in Nafion 701, as determined either by pressure drop measurements or by mercury intrusion techniques, are as follows:

(1) Cross-sectional area—1 micron by 10 microns;
(2) Individual interconnection lengths to form labyrinthene pores extending through membrane—approximately 3 to 30 microns;
(3) Void volume—40 to 50 percent;
(4) Air flow through the diaphragm ranges from 0.02 to 0.06 SCFM per $1N^2$ at 20 CM mercury vacuum. With a 22" hydraulic head relative to the catholyte, anolyte flows through the membrane at a rate of 20 to 40 cc per minute per $FT^2$ of membrane.

Microporous membranes such as the cationic Nafion 701 membrane, are essentially laminates consisting of a loose or open weave supporting fabric embedded in an intermediate polymer which serves as a precursor of the polymer sites. The preferred intermediate polymers, due to their inertness, chemical stability, etc., are perfluoro carbons. The intermediate polymer is converted to one containing ion exchange sites by converting sulfonyl groups ($—SO_2F$ or $—SO_2Cl$) to ion exchange sites such as $—(SO_2NH)_nQ$ where Q is an H, $NH_4$ cation of an alkali metal, or a cation of an alkaline earth metal and n is the valence of Q, or to the form $—(SO_3)_nMe$ where Me is a cation and n is the valence of the cation.

In addition to the support fabric, a number of randomly distributed additional fibers are initially incorporated in the laminate. These additional fibers are subsequently removed chemically to produce the labyrinthene pores. The removable fibers may be made of various materials, nylon, cellulosic materals, e.g., rayon cotton, paper, etc. which are removable by leaching with agents such as sodium hypochlorite, etc., agents which will not have a deterimental effect on the polymer.

Flow rate may be controlled both by controlling pore size and the hydraulic head of the incoming brine anolyte relative to that of the catholyte.

ELECTRODES

A gas permeable, porous catalytic electrode is bonded to at least one surface of the hydraulically permeable separator membrane. As pointed out previously, and as described in detail in the aforementioned Coker application, Ser. No. 922,316, the bonded anode preferably includes reduced oxides of platinum group metals such as ruthenium, iridium, etc. The reduced platinum metal group oxides are stabilized against chlorine and oxygen evolution to minimize corrosion. Stabilization is effected by temperature (thermal) stabilization; i.e., by heating the reduced oxides of the platinum group metal, at a temperture below that at which the reduced oxides begin to be decomposed to pure metal. Thus, the reduced oxides are heated from thirty (30) minutes to six (6) hours at 350°-750° C. with the preferable stabilization procedure involving heating for one (1) hour in the temperature range of 550° to 600° C. The reduced oxides of ruthenium, may include reduced oxides of other platinum group metals, such as iridium, or also with reduced oxides of valve metals, such as titanium, tantalum, and with other extenders such as graphite, niobium, zirconium, hafnium, etc.

The cathode is preferably a bonded mixture of Teflon particles and platinum black with a loading of 0.04 to 4 milligrams $cm^2$.

The alloys of the reduced platinum group metal oxides along with reduced oxides of titanium and other transition metals are blended with Teflon to form a homogeneous mix. Metal loading, for the anode may be as low as 0.6 milligrams/$cm^2$ with the preferred range being one to two (1-2)mg/$cm^2$.

The reduced platinum group metal oxides are prepared by thermally decomposing mixed metal salts. The actual method is a modification of the Adams method of platinum preparation of the inclusion of thermally decomposable halides or ruthenium, iridium of the selected platinum group or other metals such as titanium, tantalum, etc. As one example, if ruthenium and iridium are the platinum group metal catalysts, i.e., $(Ru, Ir)O_x$, finely divided salts of ruthenium and iridium are mixed in the same weight ratio as desired in the thermally stabilized, reduced oxide catalyst. An excess of sodium nitrate or equivalent alkali metal salt is incorporated and the mixture fused in a silica dish at 500°-600° C. for three (3) hours. The residue is washed thoroughly to remove nitrates and halides still remaining. The resulting suspension of oxides is reduced at room temperature by electrochemical reduction, or, alternatively, by bubbling hydrogen through the suspension. The product is dried thoroughly, ground finely and sieved through a nylon mesh screen. Typically after sieving the particles may have a 37 micron ($\mu$) diameter.

The reduced oxides are then, as described previously, thermally stabilized and the electrode is prepared by mixing the oxides, if so desired, with transition metals, conductive extenders such as graphite, etc. The catalytic particles are then mixed with particles of a fluorocarbon polymer such as Teflon and the mixture is heated and sintered into a decal which is then bonded to the membrane by the application of heat and pressure.

The anode current collector may be a platinized niobium screen of fine mesh. Alternatively, an expanded titanium screen coated with ruthenium oxide, iridium oxide, transition metal oxide, or a mixture thereof, may also be used as an anode current collecting structure.

The electrodes bonded to the hydraulically permeable membrane separator are made gas permeable to allow gases evolved at the electrode-membrane interface to escape readily. The bonded anode is porous to allow penetration of the pressurized aqueous halide feed stock to the membrane and to the pores for transport through the pores to the cathode side of the membrane. Similarly, if the cathode is bonded to the membrane, it has to be porous to allow penetration of the sweep water to the electrode/membrane interface to aid in diluting the NaOH formed at the membrane electrode interface. In order to maximize penetration of the aqueous feed stock to the electrode, the Teflon content of the anode electrode should not exceed 15 percent to 50 percent by weight, as Teflon is hydrophobic. By limiting the Teflon content, and by providing a very thin, open electrode structure, good porosity is achieved to permit ready transport of the aqueous solutions through the electrode to the membrane and hence to the pores extending from opposite sides of the membrane to permit hydraulic transport of anolyte to the cathode.

The current collector for the cathode must be carefully selected since the highly corrosive caustic present at the cathode attacks many materials, especially during shutdown of the cell. The current collector may take the form of a nickel screen, since nickel is resistant to caustic. Alternatively, the current collector may be constructed of a stainless steel plate with a stainless steel screen welded to the plate. Another cathode current structure which is resistant to or inert in the caustic solution is graphite, or graphite in combination with a nickel screen, pressed to the plate and against the surface of the electrode.

EXAMPLES

Cells incorporating hydraulically permeable membrane separators having at least one catalytic electrode bonded to the surface of the membrane were constructed and tested to illustrate the operational characteristics of a cell incorporating such a bonded electrode and porous membrane. A cell was constructed utilizing a 0.05 $FT^2$ Nation 701 membrane. A cathode having a 4 milligram/$cm^2$ platinum black catalyst loading with 15 percent by weight of the T-30 Nafion was embedded on one side of the membrane and an anode electrode with a two (2) milligrams per $cm^2$ loading of temperature stabilized, reduced oxides of ruthenium with 4 milligrams per $cm^2$ of graphite and 20 percent by weight of Teflon was bonded to the other side. A platinum-clad niobium screen was used as the anode current collector and a nickel screen as a cathode collector. A saturated brine solution at 290 grams per liter was introduced with a 22 inch hydraulic head relative to the catholyte resulting in an anolyte membrane transport rate of 20 to 40 cc per minute per $FT^2$ of membrane. The cell was operated at 90° C. and voltage as a function of current density was measured. The cathode current efficiency of the cell was 70 percent at 2 M NaOH because of the relatively low brine flow rate. By increasing the hydraulic head, brine flow across the membrane can readily be increased thereby increasing cathode current efficiency to 90% or better.

A conventional asbestos diaphragm cell was prepared and run under the same conditions.

FIG. 3 illustrates graphically the results for a cell utilizing a hydraulically permeable Nafion 701 membrane with bonded electrodes, and the results for a conventional asbestos diaphragm cell. The cell voltage is shown along the ordinate and the current density in amperes per square foot (ASF) along the abscissa. The cell embodying the invention was operated at current densities up to 300-350 ASF. Th conventional asbestos diaphragm cell was operated up to 150 amperes per square foot which is approximately the maximum current density for asbestos cells because at current densities greater than 150 ASF the gas evolution is so rapid and intense that asbestos fibers are torn away from the membrane, thereby eroding the membrane to the point of destruction.

Curve 40 of FIG. 3 shows the polarization curve of the cell with a porous membrane and bonded electrodes, while curve 41 shows the polarization characteristics of the conventional asbestos diaphragm cell. Thus, at 150 amperes, the voltage for the cell using a non-fibrous, porous membrane with bonded electrodes is approximately 2.7 volts, whereas the corresponding asbestos diaphragm cell voltage is 3.3 volts, an improvement of 0.6 volt. At 300 ASF, cell voltage is approximately 3.3 volts; i.e., about the same as the cell voltage of an asbestos diaphragm cell operating at half the current density. The addition of one or more bonded catalytic electrodes to a perforated hydraulically permeable membrane separator in a halogen generating cell has substantial advantages over known systems utilizing hydraulically permeable separator membrane diaphragms in that the cell operating voltage, and hence the economics of the process, are improved substantially. Furthermore, it can be seen from curve 40, that the cell can be operated at substantially higher current densities than conventional asbestos diaphragm cells. This, of course, is a very significant advantage in terms of a capital equipment costs.

It will be appreciated, therefore, that a superior process for generating halogens such as chlorine from alkali metal halides such as brine, is made possible by means of an arrangement in which the membrane separator is hydraulically permeable, but includes one or more catalytic electrodes bonded directly to the surface of the membrane, therefore resulting in a much more voltage efficient process in which the required cell potential is significantly better (up to 0.6 of a volt or more) than known processes and cells utilizing hydraulically permeable diaphragms such as asbestos diaphragms with separate electrodes.

While the instant invention has been shown in connection with a preferred embodiment thereof, the invention is by no means limited thereto, since other modifications of the instrumentalities employed or the steps of the process may be made and fall within the scope of the instant invention. It is contemplated by the attendant claims to counter any such modifications that fall within the scope and spirit of this invention.

What we claim as new and desire to secure by Letters Patent of the United States is:

1. A process for generating halogens and alkali metal hydroxide which comprises electrolyzing an aqueous alkali metal halide between a pair of electrodes separated by a porous, hydraulically permeable, non-fibrous, non-metallic membrane, at least one of the electrodes comprising an electrochemically active layer bonded to the membrane to provide a unitary gas and electrolyte permeable catalytic electrode and membrane structure, an electron current conducting structure having a surface resistant to attack by the electrolyte to which it is exposed and in contact with the electrode, applying a potential to the current conducting structure in contact with the electrode.

2. The process according to claim 1 wherein the alkali metal halide anolyte is pressurized to provide anolyte and ion transport through the membrane pores to the cathode.

3. The process according to claim 1 wherein a plurality of labyrinthene pores extend through the membrane, the path length of said pores being greater than the thickness of the membrane.

4. The process according to claim 1 wherein the electrode bonded to the membrane is the cathode electrode.

5. In the process for generating chlorine by electrolysis of aqueous alkali metal chloride by means of a pair of catalytic electrodes separated by a hydraulically permeable non fibrous, polymeric membrane, the improvement which comprises conducting the electrolysis with a membrane having a plurality of labyrinthene pores extending therethrough and a catalytic electrode comprising a layer of electrochemically active particles bonded to the surface of the membrane at a plurality of points to form a unitary membrane and electrode structure, an electron current conducting structure contacting said bonded electrode and exposed to the chlorine electrolyte, applying a potential to said current collector to permit electron current flow to the electrodes.

6. The process according to claim 5 wherein both the cathode and anode electrodes are bonded to the membrane and electron current conducting structures contact the surfaces of both electrodes.

* * * * *